United States Patent [19]

Ficheux et al.

[11] 4,402,386

[45] Sep. 6, 1983

[54] SELF-POWERED ELEVATOR USING A LINEAR ELECTRIC MOTOR AS COUNTERWEIGHT

[75] Inventors: René Ficheux, Vincennes; Marcel Pavoz, Nanterre, both of France

[73] Assignee: Otis Elevator Company, Farmington, Conn.

[21] Appl. No.: 284,836

[22] Filed: Jul. 20, 1981

[30] Foreign Application Priority Data

Sep. 30, 1980 [FR] France ..... 80 20959

[51] Int. Cl.[3] ..... B66B 11/04

[52] U.S. Cl. ..... 187/29 R; 187/94

[58] Field of Search ..... 187/29, 17, 28, 94; 310/12; 318/135, 687

[56] References Cited

U.S. PATENT DOCUMENTS

| | | | |
|---|---|---|---|
| 3,101,130 | 8/1963 | Bianca | 187/94 X |
| 3,162,796 | 12/1964 | Schreiber et al. | 318/687 X |
| 3,566,224 | 2/1971 | Vallauri et al. | 318/135 |
| 3,638,093 | 1/1972 | Ross | 318/687 |
| 3,878,916 | 4/1975 | White, Jr. | 187/94 X |
| 4,220,899 | 9/1980 | Von Der Heide | 318/135 |
| 4,303,870 | 12/1981 | Nakamura et al. | 310/12 X |

*Primary Examiner*—J. V. Truhe
*Assistant Examiner*—W. E. Duncanson, Jr.
*Attorney, Agent, or Firm*—Robert E. Greenstein

[57] ABSTRACT

An elevator system using a linear induction motor for propulsion. The linear induction motor is mounted in the elevator counterweight along with a battery, motor control equipment, and battery charger. The counterweight is guided by a tubular rail which acts as the motor armature.

7 Claims, 2 Drawing Figures

SELF-POWERED ELEVATOR USING A LINEAR ELECTRIC MOTOR AS COUNTERWEIGHT

DESCRIPTION

1. Technical Field

The invention relates to a new type of self-powered elevator. Specifically, it concerns a self-powered elevator having an inverter controlled asynchronous linear electric motor as counterweight.

2. Background Art

It is known that in convention electric elevators, the car is attached at the extremity of a rope, the other extremity thereof being equipped with a counterweight. The electric motor draws the car by means of a traction sheave over which a rope passes, itself driven by friction.

In practice, to operate in satisfactory conditions, both from the technical standpoint and to ensure the safety of passengers, the car and counterweight have to satisfy the following equation (1), well known to technicians:

$$\frac{T_1}{T_2} \times C_1 \times C_2 \leqq e^{f\alpha}$$

in which $T_1/T_2$ is the ratio between the static forces exerted respectively by the car and the counterweight on portions of the rope located on either side of the traction sheave, $C_1$ is a constant dependent on acceleration, deceleration and other factors specific to the considered facility, $C_2$ is a coefficient that takes into account the variation in the profile of the sheave groove due to wear, f is the friction coefficient of the rope on the sheave, and $\alpha$ is the angle of wrap of the rope on the sheave.

Thus, equation (1) sets a limit to the reduction in the considered weight (weight of car) with respect to the duty load, and determines a relation between the car area and the load, generally in conformity with elevator safety standards. Moreover, a rope and sheave system cooperating by friction calls for frequent inspection of the facility.

At the present time, energy considerations lead to reducing as far as possible the masses of the moving systems. On the other hand, to provide passengers with adequate comfort, the tendency is rather to increase the volume of elevator cars.

To address these contradictory criteria, a number of solutions have been considered in the trade.

Thus, for instance, it has been suggested to increase the traction exerted on the sheave, while reducing rope wear, by lining the inside of the sheave groove with plastic materials. Such improvement, however, only has a limited scope and, furthermore, has few practical applications.

Another approach has been to have hydraulically controlled elevators, which reduces the masses in motion, but involves an energy consumption far greater than is the case with electrically controlled elevators used to perform similar functions. It has also been suggested to have counterweights to partially compensate the weight of the car, but the cylinder controlling the motion must be able to return without load in the car, thereby limiting the weight compensation by a counterweight. This means that hydraulic elevators are not competitive from the energy savings standpoint. Furthermore, the technique is limited by the car's travel height and speed.

Yet, another approach is to have a drum system in which car and counterweight have separate ropes which are oppositely wound on the same drum. The solution, however, is no more satisfactory than the previous ones, since for a given travel height of the car, a drum of very great width is required, which is incompatible with the present dimensions of premises set aside for machine rooms.

DISCLOSURE OF INVENTION

The invention aims to remedy these drawbacks by suggesting a new type of elevator in which the weights may be reduced as compared with existing systems, while providing enhanced comfort to passengers.

To this effect, the invention covers a self-propelled elevator in which a car is attached to one extremity of a rope which runs over a sheave, and at the other extremity of which is suspended a counterweight designed to balance the weight of the car and part of the payload, wherein such elevator sheave is a simple return sheave, and the motor system comprises a linear induction motor forming an integral part of the counterweight and cooperating with the counterweight guide rail.

Provided the facility is equipped with an adequate static braking system, which, however, may be of known type as specified hereinafter, it is possible to overcome the limits generally imposed by the ratio between the area of the car and the payload, thus ensuring increased comfort to users.

The motor may preferably be fed with current from a main feeder, connected to a floating battery across a charger, the battery itself being connected to the motor across an inverter. All the components, of known type, may form a constituent part of the counterweight, and have two functions: the first, as usual, being to control the motion of the car; the second, specific to the elevator according to the invention, wherein the components form a constituent part of the counterweight, being that their mass partially or totally contributes to offsetting the weight of the car and part of its duty load.

If desired, the inverter may be of reversible type, thereby further contributing to cutting down current consumption.

The battery may be recharged by means of a suspended cable, or preferably by means of socket connectors located at the main landing level. Or again, automatic return of the car may be provided when the elevator is idle.

Alternately, it is possible to eliminate the charger by feeding the battery directly from a solar cell located on the building. Such a solution would be particularly appropriate for regions having strong sunlight. In this case, it would be advisable to provide a suspended cable for continuous feed from the battery. It would also be possible to combine such a system with conventional electrical supply, whereby an automatic device would switch over from solar power to mains supply when the sunlight drops below a predetermined threshold.

It will be noted that the elevator according to the invention imposes no limit on height or speed of travel in respect of the counterweight.

Another form of the invention features a toroidal electric motor arranged to slide on a hollow cylindrical guide rail, reaching from the pit to the ceiling of the topmost storey, in so far as the travel and payload permit, meaning, in general, in residential buildings in which penthouse machinery is forbidden.

The electrical system may also comprise regenerative braking, but the elevators should be provided with braking means usable when stopped and/or in emergency conditions. Since the sheave used is not a drive sheave, it can play no part in such braking. Hence, the simplest solution would be to install the braking system on the elevator car in order that it may act directly on the car guide rails, requiring a set of friction linings and an electro-magnet energized when the elevator is in motion.

BEST MODE FOR CARRYING OUT THE INVENTION

Figure 1:
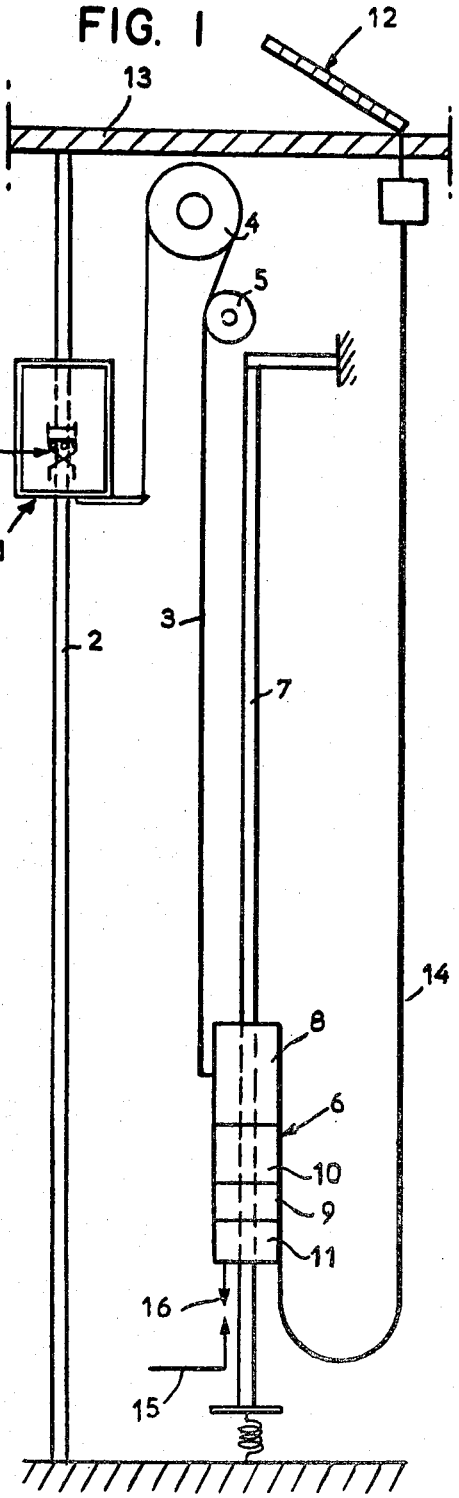
FIG. 1 is an elevational view of an elevator system embodying the present invention, showing an elevator at an upper floor or landing.

FIG. 1 depicts elevator car 1 sliding on two guide rails 2, suspended by rope 3 which runs over main sheave 4 and over deflecting sheave 5, the other end of the rope consisting of a counterweight designated by generic reference 6, arranged to slide along vertical guide rail 7.

According to the invention, sheaves 4 and 5 are idlers and have no drive function, such function devolving on linear electric induction motor 8, which forms an integral part of counterweight 6, and which cooperates with guide rail 7, acting as an armature. As stated previously, guide rail 7 would with advantage be cylindrical and hollow, while motor 8 will be toroidal in shape and will surround guide rail 7.

Linear motor 8 is fed by battery 9, across an inverter 10, which together form an integral part of counterweight 6, alongside with battery charger 11. As shown on the drawing, such charger 11 is fed from two separate sources, one from solar photocell panel 12 installed on roof deck 13, to which charger 11 is connected by a flexible suspended cable 14; the other from mains supply system 15, to which charger 11 is connected when counterweight 6 is stopped in bottom position, across socket connectors 16.

As stated above, braking of the car is ensured by device 17, carried on car 1, and cooperating with guide rail 2 of the car.

Figure 2:
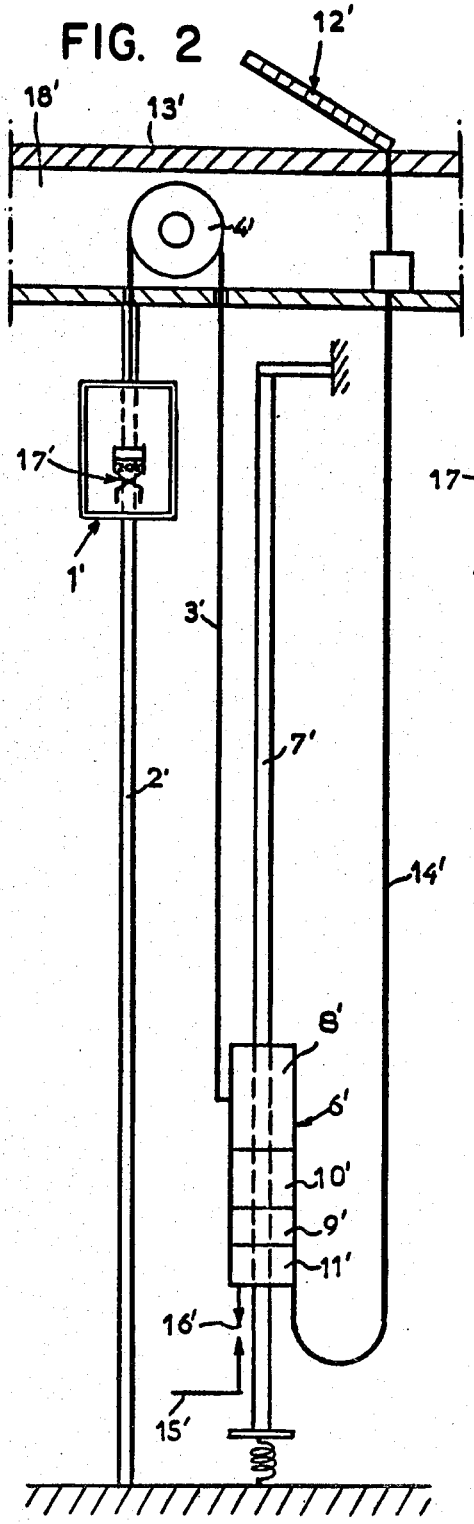
FIG. 2 is a similar view, but of a system utilizing a different rope connection arrangement between the counterweight and the elevator cab.

In the variant shown in FIG. 2, in which the components already described in connection with FIG. 1 keep the same reference numbers, but suffixed by prime (′), sheave 4′ is installed in room 18′ designed for the purpose, so that it may be dimensioned as large as desired, which permits eliminating idler sheave 5, thereby still further reducing wear on the sheave and on the rope.

A feature of the elevator according to this invention is the additional advantage of being extremely silent. Moreover, since in normal operation the braking system has no dynamic or regenerative action and since the use of the battery obviates sudden stops due to failure of the mains supply, wear on the friction lining is reduced and maintenance is lessened. In addition, since it is no longer necessary to observe the ratio between car weight and area in the usual types of electric elevators, the only condition imposed on the braking system is that it is capable of holding the car stopped in the event of overload thereof, in order to ensure the safety of the passengers.

An elevator logic monitoring device—determining direction of travel in response to a call from the car or from a landing, storing the calls, slow-down instruction, stop instruction or any other—of known type, contained in a cabinet or decentralized into several parts, may be installed in some convenient location.

To one skilled in the art, other modifications, variations and substitutions may be made to the described system, in whole or in part, without departing from the true scope and spirit of the invention.

We claim:

1. An elevator system comprising an elevator car and a shaftway in which the car moves, characterized by: a counterweight, a rail extending the length of the shaftway, a stator of a linear induction motor carried on the counterweight, means for powering the motor, a sheave at the top of the shaft, a rope guided over the sheave for connecting the car and the counterweight, and the rail additionally functioning as the motor armature.

2. An elevator system according to claim 1, characterized in that the rail is tubular, and the linear induction motor is of the toroidal type having a toroidal stator which coaxially extends around the rail and the rail extending through the stator.

3. An elevator system according to claim 1 or 2, characterized by a battery, an inverter powered by the battery for providing power for the motor armature, means for charging the battery, and the inverter and battery being housed in the counterweight.

4. An elevator system according to claim 3, characterized in that the battery charger means is housed in the counterweight.

5. An elevator system according to claim 4, characterized by means for providing power to said battery charger when the counterweight is at a first position at either end of the shaft, said means comprising power coupling apparatus having two connectable parts for transmitting power through the apparatus, one carried on the counterweight and connected to the charger, the second attached in the shaft at a position so as to connect with the first part when the counterweight is at said first position, said second part being connected to a power supply.

6. An elevator system according to claim 5, characterized in that said source of electrical power comprises a photocell solar panel which is located on the exterior of the building housing the shaftway.

7. An elevator system according to claim 1, wherein the car rides on a guide rail, and characterized by: braking apparatus carried on the car for selectively engaging the guide rail for braking car.

* * * * *